US005847297A

United States Patent [19]

Fisher, IV

[11] Patent Number: 5,847,297

[45] Date of Patent: Dec. 8, 1998

[54] TREMOLO WITH SPACED SADDLES FOR A STRINGED MUSICAL INSTRUMENT

[76] Inventor: Charles H. Fisher, IV, P.O. Box 402, Coalport, Pa. 16627

[21] Appl. No.: 890,932

[22] Filed: Jul. 10, 1997

Related U.S. Application Data

[63] Continuation-in-part of Ser. No. 753,005, Nov. 19, 1996.

[51] Int. Cl.[6] ..... G10D 3/00

[52] U.S. Cl. ..... 84/313

[58] Field of Search ..... 84/298, 299, 312 R, 84/313

[56] References Cited

U.S. PATENT DOCUMENTS

| | | | |
|---|---|---|---|
| 4,681,011 | 7/1987 | Hoshino | 84/313 |
| 4,724,737 | 2/1988 | Fender | 84/313 |
| 5,196,641 | 3/1993 | Schaller | 84/313 X |
| 5,429,028 | 7/1995 | Fisher, IV | 84/313 |
| 5,481,955 | 1/1996 | Goto | 84/313 |

*Primary Examiner*—Jonathan Wysocki
*Assistant Examiner*—Jeffrey W. Donels
*Attorney, Agent, or Firm*—Gipple & Hale

[57] ABSTRACT

A string mounting and tuning device is disclosed for use in the body of a stringed instrument, the device having a cast zinc alloy saddle platform and integral attachment block. The saddle platform is formed with a saddle support plate with a flange at the distal end thereof, the flange being provided at a plurality of apertures holding longitudinal adjustment screws so that each longitudinal adjustment screw extends through an aperture and threadably engages a string saddle cast of the same material as the saddle platform allows the position of each saddle to be adjusted by turning the respective longitudinal adjustment screw. The saddles which are also cast of the same zinc alloy material as the saddle platform and integral attachment block are spaced from each other a predetermined distance so that they do not touch providing purer sound quality.

20 Claims, 8 Drawing Sheets

22
49
45
147
40
90
88
71
67
29
57
31
70
60
59
74
62
86
84
84b
42a
84a
42
24
34
35
117
127
36

Fig. 18
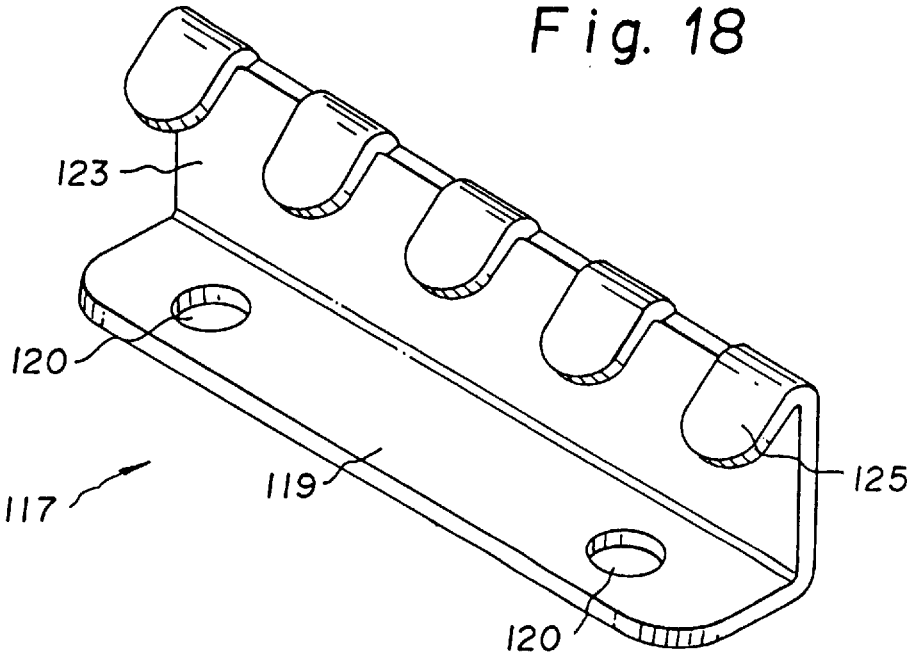
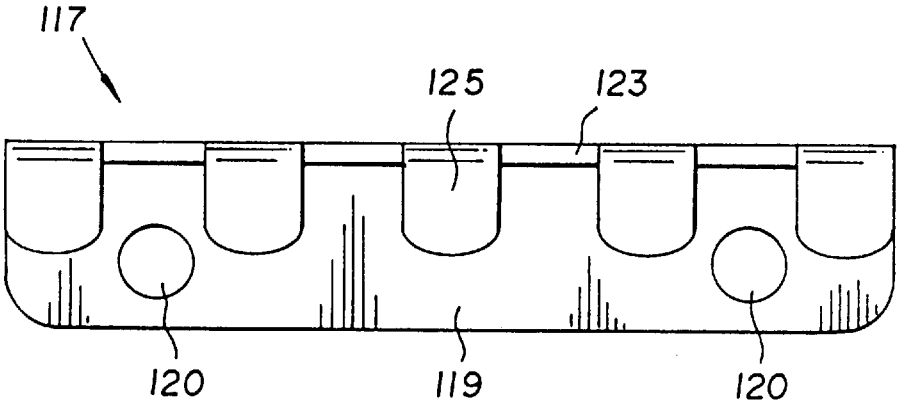
Fig. 19

TREMOLO WITH SPACED SADDLES FOR A STRINGED MUSICAL INSTRUMENT

RELATED CASES

This is a continuation-in-part of U.S. patent application Ser. No. 08/753,005 filed Nov. 19, 1996.

BACKGROUND OF THE INVENTION

The present invention generally relates to a bridge and saddle assembly for use in a tremolo for a stringed musical instrument having improved sound quality. More specifically, the invention is directed to a tremolo having a bridge mechanism with separated spaced saddles both of which are constructed of the same alloy material. The improved and simplified tremolo is fully adjustable and yet has a compact configuration for versatile applications on various stringed instruments.

BRIEF DESCRIPTION OF THE PRIOR ART

Vibrato devices for stringed musical instruments are well-known in the prior art as evidenced by U.S. Pat. Nos. 5,429,962; 4,796,505; 4,724,737; 4,457,201; 3,466,962; 3,237,502; and by the British Patent Number 905,447.

U.S. Pat. No. 5,429,028, a patent issued to the present inventor, shows a floating one piece tremolo for a stringed instrument comprising a rectangular housing and a carriage pivotally mounted in the housing by means of a floating point mechanism. The carriage is biased against the housing by the action of the instrument strings and a plurality of tremolo springs opposing each other. The carriage of the '028 tremolo is spring biased and provided with string holding keys which touch each other on the carriage. The present improvement results in a tremolo with truer sound without tonal interference and discord than that of the '028 tremolo.

Another U.S. Pat. No. 4,457,201 discloses a combined bridge and tailpiece assembly for a stringed musical instrument with a tailpiece member which is manually rotated to produce a vibrato effect. The tailpiece member is rotatably connected at its ends with the tailpiece block through screws having a smaller diameter portion. The screws are threaded into aligned openings of the tailpiece block with the smaller diameter portion of the screws passing through the central portion of ball bearing races mounted in opposite aligned longitudinal openings in the vertical leg portion to connect the vertical leg portion of the tailpiece member at its ends with the tailpiece block of the assembly. Adjustable string attachment devices in the form of inset blocks, (one inset block for each of the instrument strings) are each provided with a thoroughgoing bore to receive a longitudinal rod which passes through aligned openings contained in the base and aligned bores formed in the inset blocks. Each inset block includes a hook portion which holds an eyelet portion of the instrument string end. A plurality of adjustable saddle rollers are mounted on the tailpiece block and act as a bridge to guide the respective instrument strings to the string attachment devices.

U.S. Pat. No. 3,237,502 discloses a vibrato unit for stringed instruments which includes an adjustable bridge with independent brackets mounted thereon for adjusting the pitch of individual strings. Similarly, U.S. Pat. No. 3,466,962 discloses a tremolo device having an eccentrically mounted cradle member which is rotated relative to a base plate to vary the tone of the sound of the strings. The tremolo plate has connector members for the strings mounted thereon. Another U.S. Pat. No. 4,796,505 shows a tremolo arm adjustment mechanism which affects the position and movement of a tremolo arm. A plurality of saddles are directly mounted on a horizontal planar portion of the tremolo unit and are held by a screw and spring assembly on a vertical portion rising from the rear end side of the horizontal planer portion. Another U.S. Pat. No. 4,724,737 discloses a tuning system for a vibrato guitar. The saddles are mounted adjacent each other and have slidable engagement.

British Patent Number 905,447 patent discloses a vibrato bridge with a base having a pivotal platform. A bridge is arranged on the platform adjacent the pivot and parallel to the axis thereof, and string attachment means are attached to the platform at one side of the bridge and pivot. A lever arm is attached to the platform to pivot the same on the base to change the tension on the strings to produce a vibrato effect.

The saddles and bridge mechanism of the present invention are specifically constructed to provide truer sound quality than the tremolos in the prior art. As can be seen from a review of the prior art the present inventive construction greatly reduces the number of parts in the assembly and simplifies the construction of the tremolo.

While the prior art tremolo devices allow the user to initially provide the desired musical result, they each possess certain inherent drawbacks which limit their versatility. The string keys or saddles of present tremolos engage the adjacent keys or saddles and are of a different material composition from the bridge on which they are mounted which results in discords and sound wave vibration interferences.

The present invention was developed to provide a combined assembly which is quickly and easily secured to the body of a stringed musical instrument with a clean, functional appearance. Individual strings can be simply changed or replaced. The assembly includes a rotatable bridge member on which the individual strings are removably mounted and string adjustment saddle mechanisms are disposed. The saddle mechanisms are spaced from each other so that there is no contact to eliminate sound wave transfer between the adjacent saddles and the bridge on which they are seated.

SUMMARY OF THE INVENTION

The inventive tremolo assembly of the present invention incorporates adjustable saddle members which are spaced from adjacent saddle members and act as individually adjustable tone isolated bridge members for each instrument string. The saddles are cast of the same alloy material as the bridge to provide for truer sound harmonics with reduced distortion and interferences.

The present inventive tremolo assembly can be adapted to easily attach to stringed instruments of various shapes and sizes that use or already incorporate another type of tremolo. It is therefore possible to remove the tremolos from most guitars and replace them with the present invention with a minimum of rerouting or other structural modification of the instrument.

It is an object of this invention to provide a simplified tremolo design that allows easy installation on a variety of stringed instruments including simplified retro-fitting of the tremolo assembly on instruments that already have another type of tremolo installed thereon.

Still another object of this invention is to provide a tremolo assembly which stays in tune and provides for truer sound quality even under intense use with each string and respective saddle being isolated from adjacent stings to provide a truer tone.

A further object of the present invention is to provide a tremolo which can either raise or lower the pitches of the notes which are produced by the stings in their equilibrium positions and which allows for a greater distal range of motion of the rotatable portion of the tremolo than presently available enabling the player to accomplish a greater degree of tremolo backpull and a greater degree of tremolo dive per degree of downward tremolo arm movement than that which is possible with prior art tremolos.

In the accompanying drawings, there is shown an illustrative embodiment of the invention from which these and other objectives, novel features and advantages will be readily apparent.

BRIEF DESCRIPTION OF THE DRAWINGS

FIG. 18 is an enlarged perspective view of the spring claw assembly; and,

FIG. 19 is a top plan view of the spring claw assembly of FIG. 18.

DETAILED DESCRIPTION OF THE INVENTION

Figure 1:
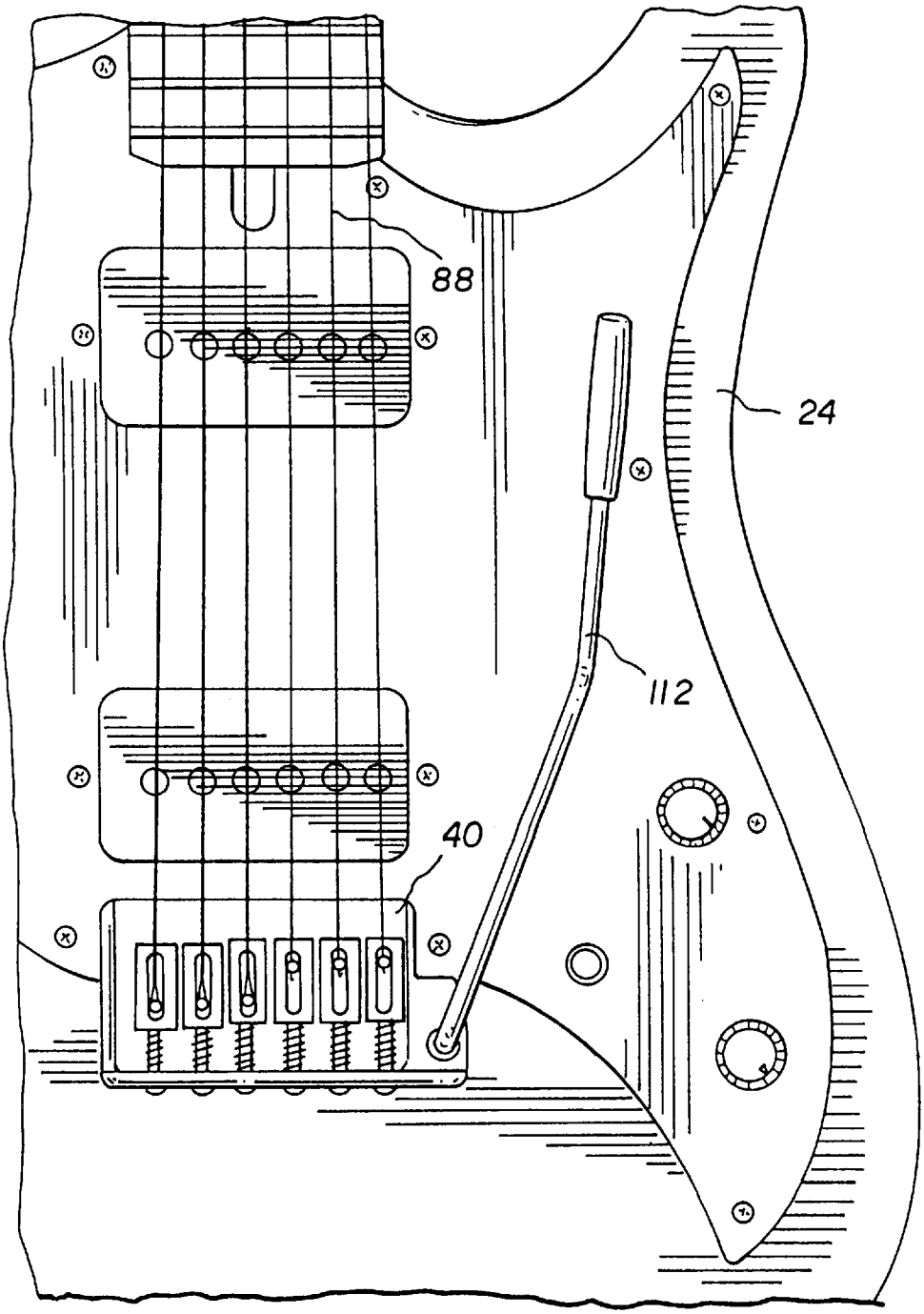
FIG. 1 is a top plan view of the simplified tremolo invention mounted in a guitar.
Figure 2:
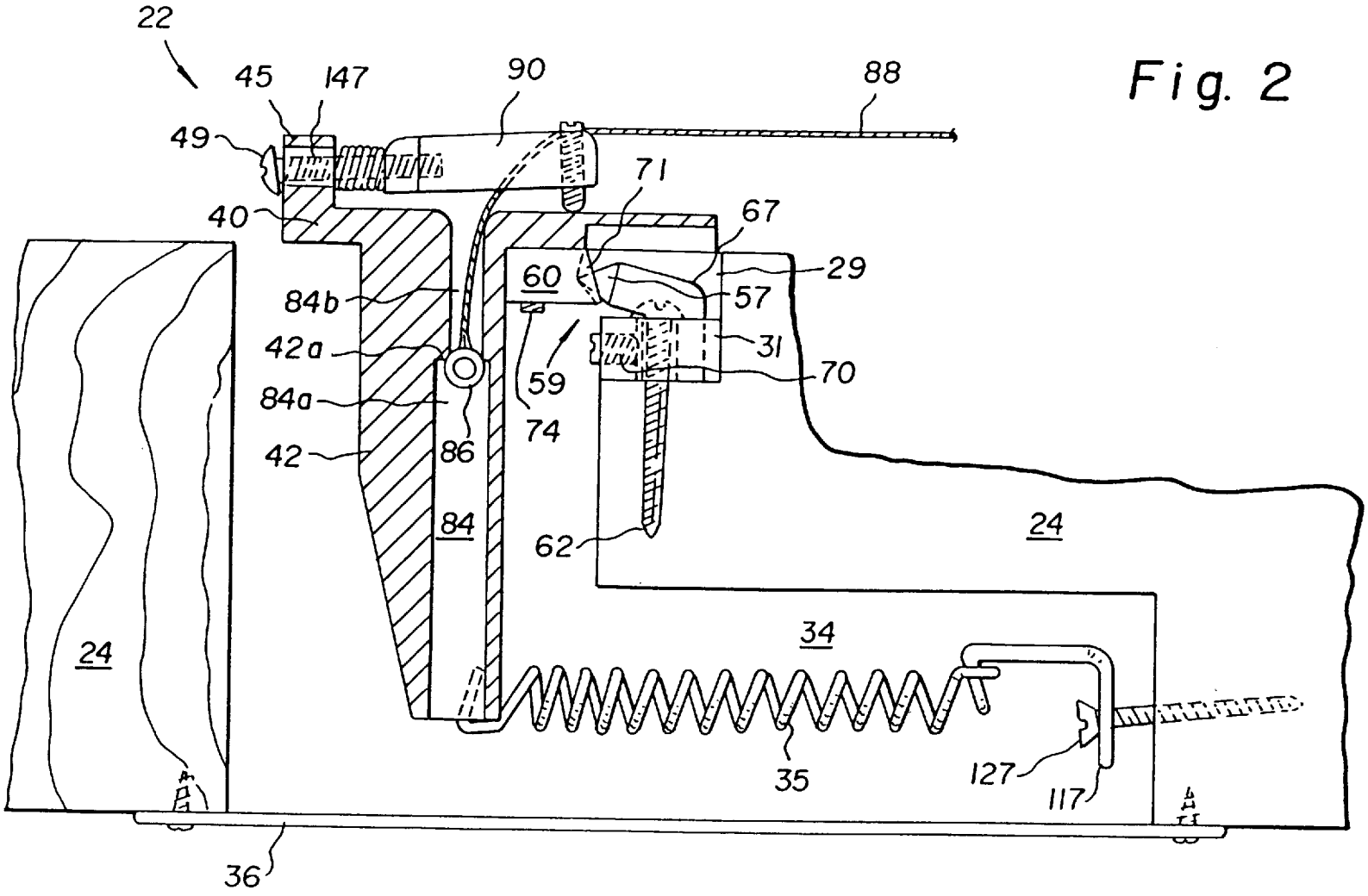
FIG. 2 is an enlarged cross sectional side view of the tremolo shown in FIG. 1 showing the tremolo mounted in the cavity of the guitar with saddle platform and saddle assembly, the point and cone mechanism, and the spring and claw assembly.
Figure 7:
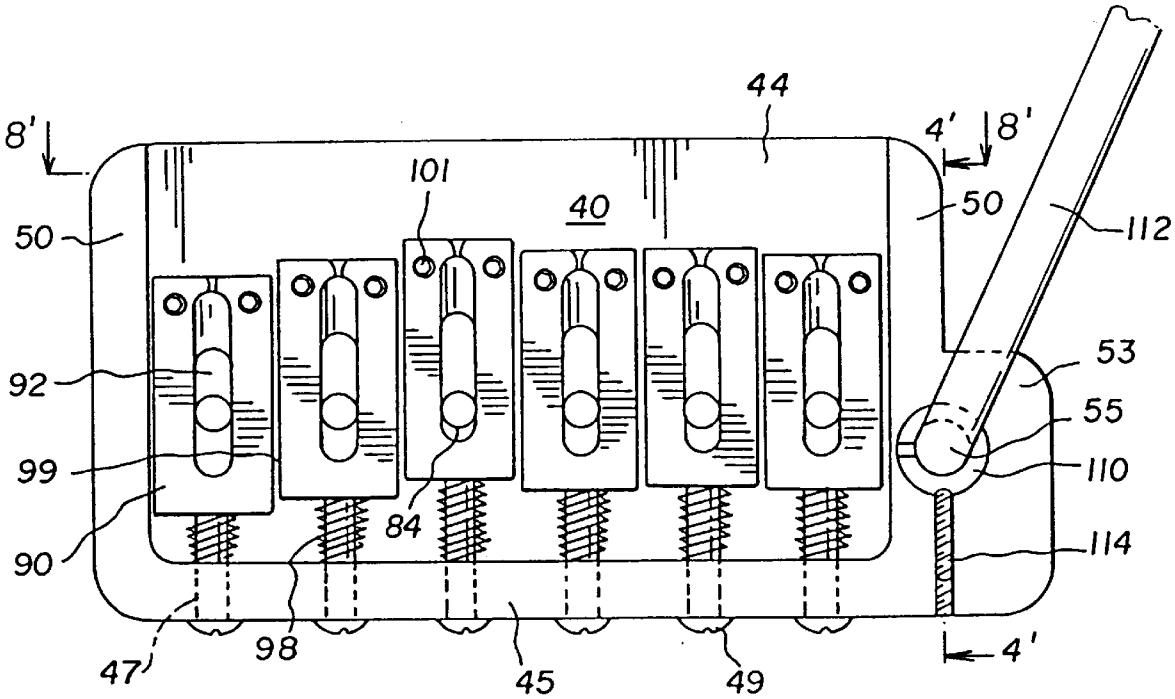
FIG. 7 is a top plan view of the saddle platform, spaced saddles, tremolo arm and clutch assembly in place.
Figure 9:
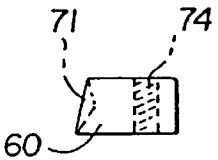
FIG. 9 is an enlarged side view of the cone bar.

The preferred embodiment and the best mode of the invention is shown in FIGS. 1 and 7. In accordance with the invention, the improved, simplified tremolo assembly, generally designated 20, is mounted into a cavity cut into stringed musical instrument 24 as shown in FIGS. 1 and 2. The instrument body 24 is routed or formed to create a cut out 29 for the installation of the point retention bar 31 and a cavity 34 to receive the tremolo housing 22 and coil springs 35. A cavity plate 36 is mounted by screws or other means to the back of the body of the instrument 24 covering the spring cavity 34.

Figure 4:
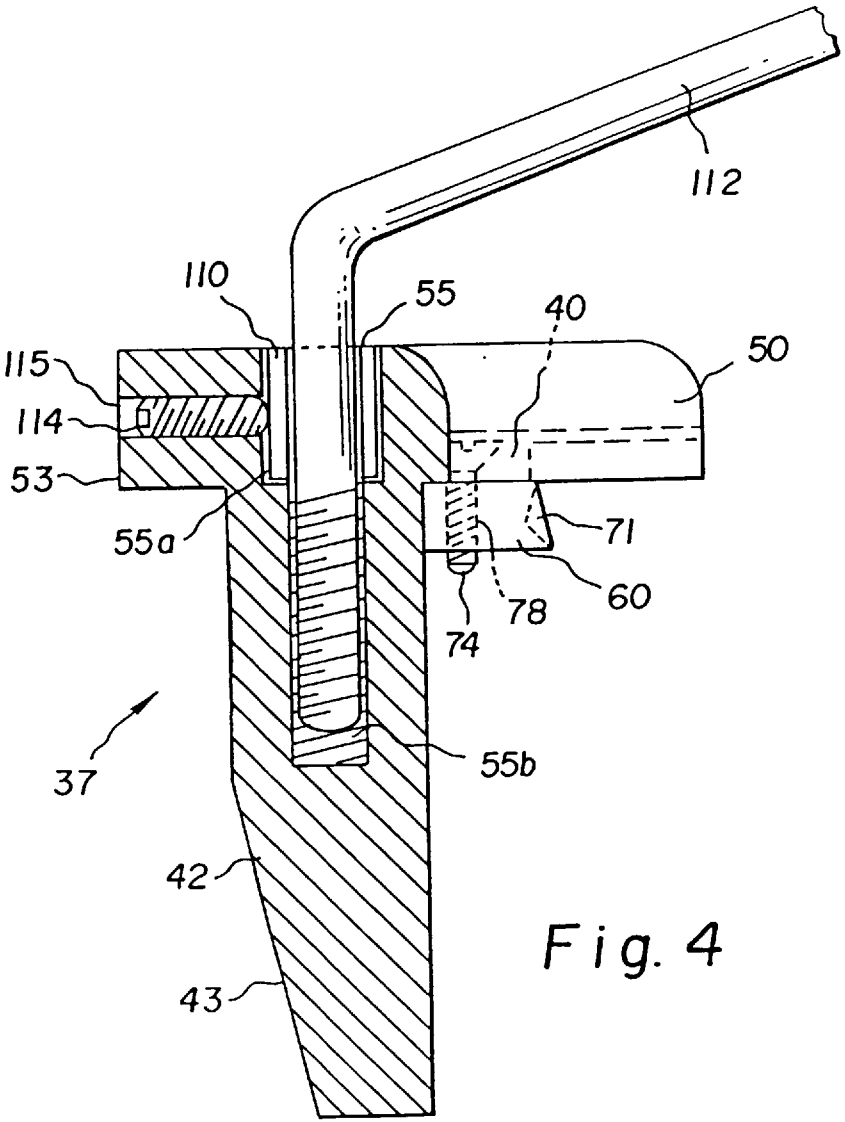
FIG. 4 is a cross sectional side view of the saddle platform with the integral spring mounting block showing the clutch assembly and the tremolo arm taken along lines 4'—4' of FIG. 7 with the tremolo arm axially aligned with the set screw bore.
Figure 3:
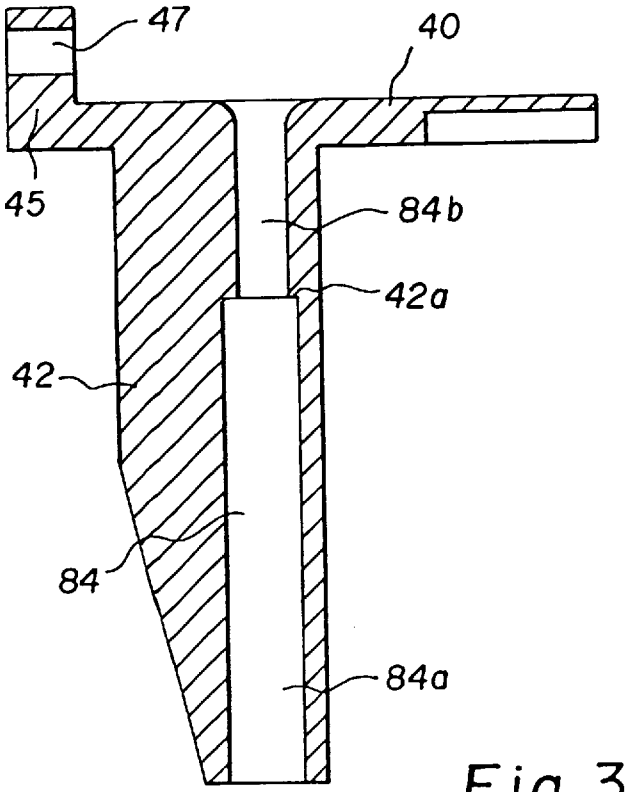
FIG. 3 is an isolated cross sectional view of the saddle platform with the integral spring mounting block shown in FIG. 2.
Figure 5:
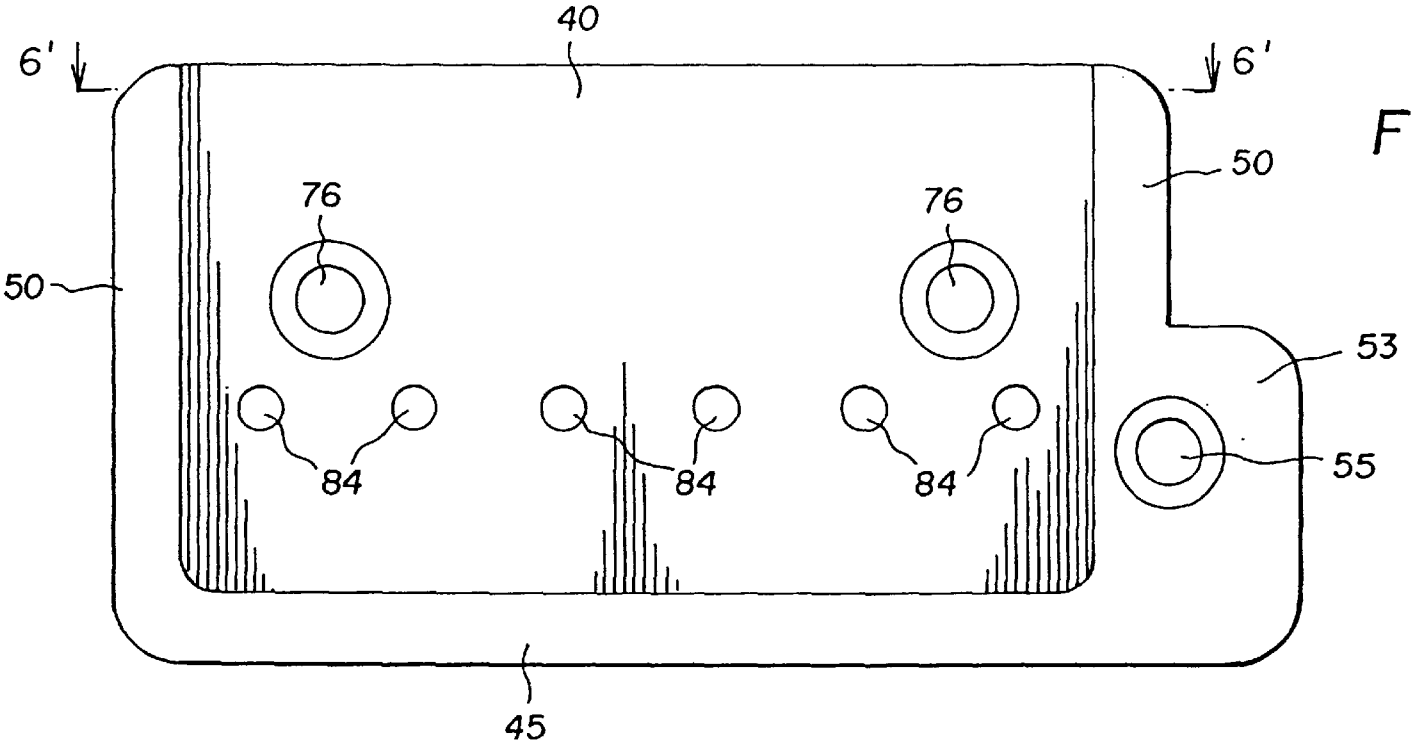
FIG. 5 is an enlarged top plan view of the saddle platform.
Figure 6:
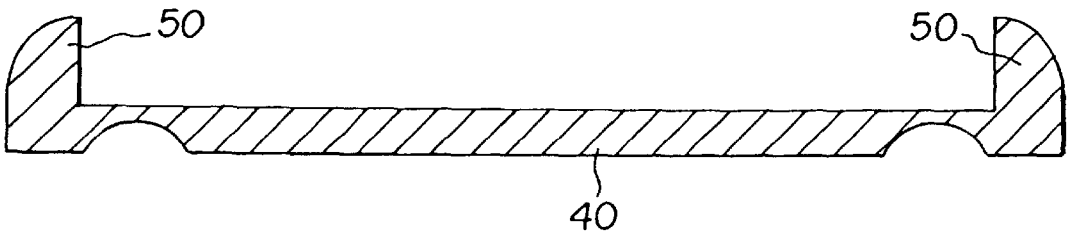
FIG. 6 is an enlarged cross sectional view of the proximal end of the saddle platform of FIG. 5 taken along line 6'—6'.

The pivoting saddle plate assembly 37 of the tremolo assembly is shown in FIGS. 2, 3, and 4. The assembly 37 comprises the saddle platform 40 shown in phantom in FIG. 4 and the integral spring mounting block 42. The saddle platform 40 which is shown in plan view in FIG. 5 is provided with upright walls or flanges on three sides so that the saddle platform 40 is a three quarters enclosed area leaving an open face or proximal edge 44. A distal flange 45 extends the length of the distal edge of the saddle platform 40 and is joined to two lateral flanges 50 which extend the length of the two lateral sides of the saddle platform 40 to form one integral and continuous flange surrounding the three sides of the saddle platform 40. The distal flange 45 has a plurality of through-going smooth saddle slide bores 47 shown in phantom in FIG. 7 to accommodate the saddle screws 49. A tremolo arm block 53 extends outward from one lateral saddle platform flange 50 and serves as the location for the tremolo arm bore 55.

Figure 10:
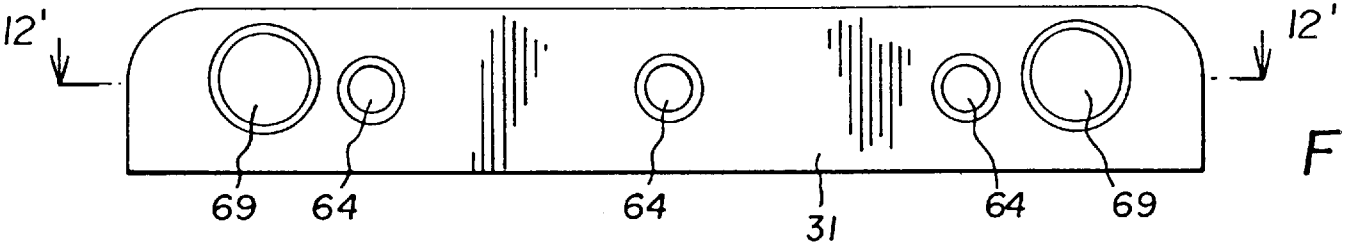
FIG. 10 is an enlarged top plan view of the point retention bar.
Figure 11:
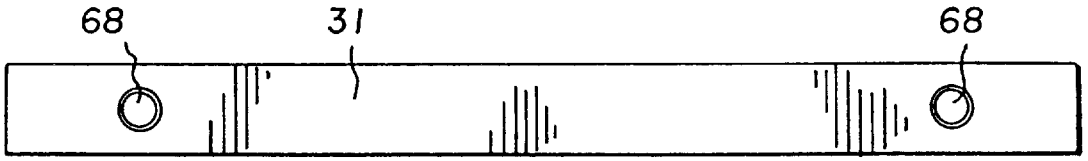
FIG. 11 is an enlarged side view of the point retention bar of FIG. 10 taken from the distal end.
Figure 12:
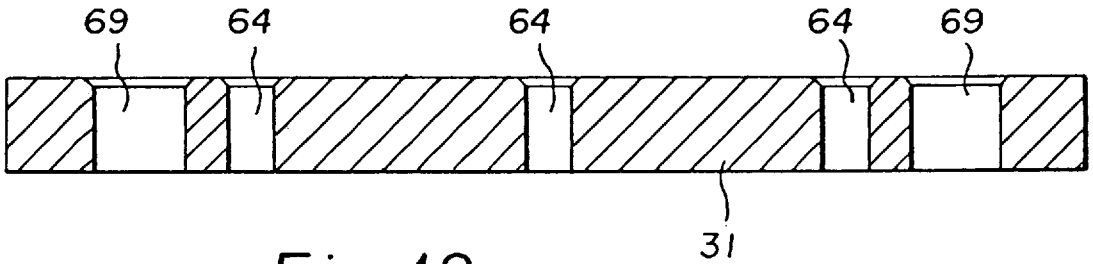
FIG. 12 is a cross section of the point retention bar of FIG. 10 taken along line 12'—12'.

The conical tips 57 of the point and cone mechanism, generally designated 59 in FIG. 2, are held on a separate point retention bar 31 (shown in FIGS. 10–12) which is affixed to the interior of the instrument body 24 by screws 62. The point and cone assembly 59 therefore operates below the saddle platform 40 and is not visible to the instrument player. The point retention bar 31 is secured to the interior of the instrument body 24 by screws 62 which pass through three countersunk smooth retention bar screw bores 64 into the instrument body 24. The conical tips 57 are formed on the ends of two angular cylindrical support posts 67.

Figure 8:
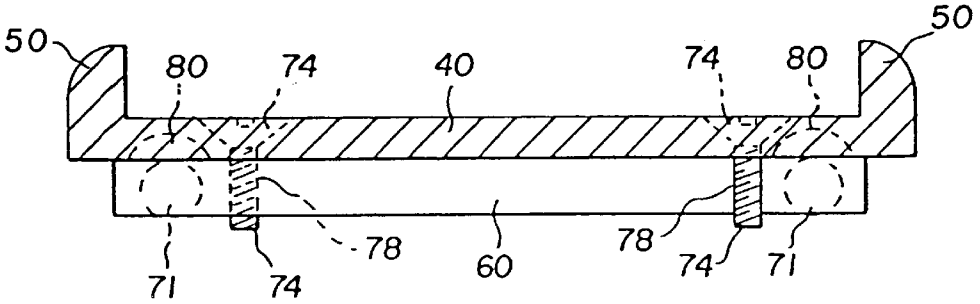
FIG. 8 is a cross sectional view of the proximal end of the saddle platform of FIG. 7 taken along line 8'—8'.
Figure 13:
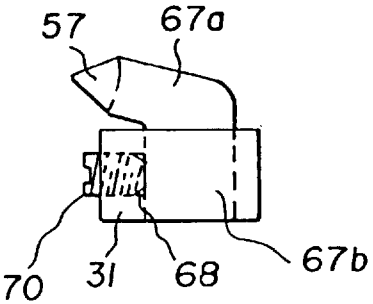
FIG. 13 is an enlarged side view of the cone bar showing the conical tip of the point and cone in place.

Each angular cylindrical support post 67 is identically bent at an angle slightly greater than 90 degrees to form an upper cylindrical support post section 67*a* and a lower cylindrical support post section 67*b*. The upper cylindrical support post section 67*a* is angled upward slightly from the 90 degree position to allow for the maximum rotation of the saddle platform 40 when it is rotated in the clockwise direction. This relationship is best seen in FIG. 2. The two cylindrical support posts 67 are mounted within two smooth retention bar bores 69 and held removably there by the set screws 70 which are located in the threaded bores 68 as is shown in FIG. 13. The conical tips 57 of the fulcrum pivotally engage a pair of identical large diameter conical or circular cavities 71. These conical cavities 71, which are also referred to as cones, are cut into a cone bar 60 which is located beneath the saddle platform 40 and secured thereto by screws 74 as is clearly shown in FIG. 8. The screws 74 pass through smooth countersunk bores 76 in the top surface of the saddle platform 40 (see FIG. 5) into two aligned threaded bores 78 in the cone bar 60. An arcuate or crescent-shaped support post indentation 80 is provided along the proximal edge of the bottom of the saddle platform 40 to allow greater clockwise rotation of the platform 40 before the bottom of the platform 40 comes into contact with the cylindrical support posts 67.

This positioning of the point and cone mechanism or fulcrum under the saddle platform or plate 40 improves the appearance and performance of the installed tremolo assembly and provides a means for rotating the rotatable portion of the tremolo assembly. Since the fulcrum is located below the surface of and away from the proximal edge of the saddle plate in the interior of the musical instrument, the angular distance the handle has to move to achieve a given angular displacement or rotation of the saddle plate is reduced by as much as 23% over the standard tremolo. This translates into as much as 23% less movement of the tremolo arm for any desired effect. The position of the fulcrum of the point and cone mechanism also allows the saddle platform to lie parallel to and in substantially the same plane as the surface of the guitar. The anatomy of the tremolo cavity allows for extreme pull-back, a quality practically non-existent in current tremolos. The shape of the cavity required to affix the internal point and cone mechanism and associated rotatable saddle plate assembly allow for easy installation of the assembly and easy retro-fitting of most guitars. The shape of the cavity required also allows for quick, easy installation of the point and cone process and with a very minimal amount of re-routing this system will retro-fit virtually any guitar equipped with a standard classic tremolo.

A spring mounting block 42 is integrally formed with the saddle platform 40. The spring mounting block 42 extends into an interior cavity 34 of the instrument 24 to provide a means for attaching the coil springs 35 thereto. The lower half 43 of the distal side of the spring mounting block 42 is tapered to allow greater clockwise movement of the platform 40 before the mounting block 42 contacts the instrument body 24. A series of string bores 84 extend through the saddle platform 40 and block 42 to provide a means for removably securing the eyelet 86 ends of the strings 88 to the tremolo 20. (See FIGS. 2 and 3.) Each smooth string bore has a stepped construction with wider lower portion 84*a* and a narrower upper portion 84*b*. The string is attached by passing one end of the string 88 into the wider portion 84*a* of the bore 84, through the narrower portion of the bore 84*b* and out the top of the saddle platform 40. The string is pulled or drawn through the bore 84 until the string eyelet 86 comes into contact with the shoulder 42*a* beginning the entrance to the narrower portion of the bore. This provides the user with a fast and easy way to attach the strings 88 or remove the strings from the tremolo 20.

A plurality of saddles 90 as shown in FIG. 7 are positioned on the top of the saddle platform 40 in the enclosed surface. The saddles 90, saddle platform 40 and block 42 are preferably cast of the same material to provide clearer tone quality and less resonance. The preferred material used is a zinc alloy ASTM B86, alloy AG40A commercially sold under Number 3 Die Casting Alloy or Zamak -3.

The composition limits are 3.5 to 4.0 Al, 0.020 to 0.05 Mg, 0.25 max Cu, 0.100 max Fe, 0.005 max Pb, 0.004 max Cd, 0.003 max Sn, rem Zn. Special high grade zinc must be used as the basic material in making this alloy. The material has a thermal conductivity 113.0 W/mK (65.3 Btu/fth °F.) at 70° to 140° C. (160° to 285° F.).

The combination saddle platform 40 tone bar is a one-piece completely uniform casting of zinc-magnesium alloy as identified above noted for its excellent sound conduction properties. The string saddles 90 are likewise cast of the same alloy, creating a uniform composition and density of metal throughout. Furthermore, the entire body of the tremolo is plated with chrome, rather than just the saddles 90 and saddle platform 40 producing an extremely smooth overall surface for optimum sound conduction. The saddles 90 function as individual bridges for each string, there being one saddle provided for each string. The saddles 90 are spaced from each other a predetermined distance 99 of at least 0.010 inches and ranging from 0.010 inches to 0.018 inches so that there is no engagement with adjacent saddles resulting in frequency isolation. The preferred spacing of the saddles 90 is 0.014 inches apart. Height adjustment screws 101 and lateral saddle screws 49 keep each saddle from contacting the platform surface.

Each string on a guitar is a different size, and when struck, each resonates at a different frequency. When adjoining string saddles touch each other as is the case in conventional tremolos, a cross-contamination of frequencies occurs which is transmitted across all six saddles. Furthermore, on most conventional tremolos, the heel of each saddle contacts the saddle platform, dampening the vibration of the string. In the present invention, the saddles do not touch each other so there is no direct cross-contamination of frequencies. In addition, the saddles are elevated above the saddle platform by the saddle height and intonation adjustment screws, greatly reducing string vibration dampening. The result is a cleaner, purer, undistorted sound with better sustains which can then be tailored by any special effects equipment for the optimum sound desired.

Figure 14:
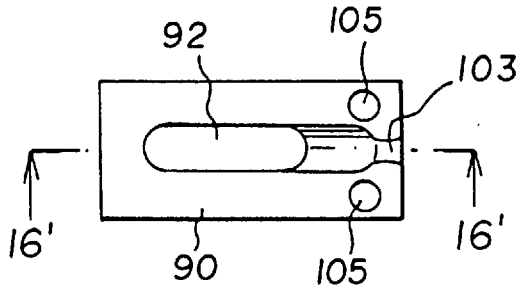
FIG. 14 is an enlarged top plan view of a saddle.
Figure 15:
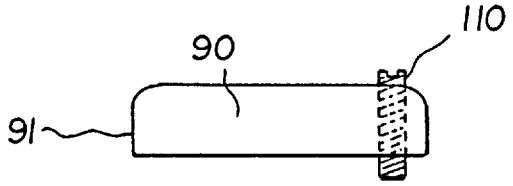
FIG. 15 is an enlarged side view of the saddle of FIG. 14.
Figure 16:
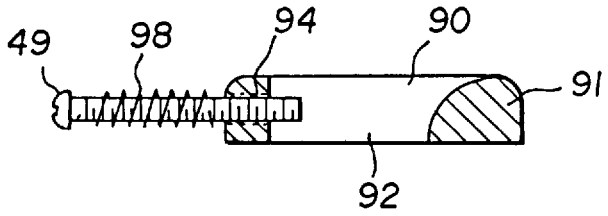
FIG. 16 is a cross sectional side view of the saddle of FIG. 14 taken along the line 16'—16'.
Figure 17:
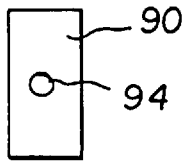
FIG. 17 is an enlarged end view of the saddle of FIG. 14.

Each saddle body 91 as shown in FIGS. 14–17 defines a central elongated aperture 92 and a threaded screw bore 94. Each saddle 90 is placed over a string bore 84 as shown in FIG. 7 and a screw 49 is inserted through the distal side of each bore 47 in the wall 45 and then into the threaded saddle body bores 94 of each saddle 90. These screws enable the player to slide the saddles 90 individually in a longitudinal path to change the position of the saddle. A biasing spring 98 is placed around each screw 49 to bias the saddle 90 away from the distal wall 45 toward the neck of the instrument. The instrument strings 88 guide the longitudinal movement of the saddles 90 and keep them aligned. The proximal end of each saddle 90 is provided with a pair of height adjustment screws 101 as shown in FIG. 15 which place the saddle 90 above the saddle platform 40 and the saddle end defines a string notch 103 between the height adjustment screws. Screws 101 extend through a pair of threaded height adjustment bores 105 as shown in FIG. 14 and are used to adjust the height of notch 103 which serves as the bridge of the saddle 90, above the platform 40.

Intonation of the instrument strings occurs after mounting the instrument strings in the string attachment bores by moving the saddles longitudinally and by adjusting the saddle height relative to the saddle plate. The individual screws 49 attached to the saddles through thorough-going apertures 47, in the flange located on the posterior edge portion of the saddle plate longitudinally adjust the saddles. Springs 98 are mounted around each screw 49 between the flange 45 and each saddle 90 to bias the saddles away from the flange. The saddle height is adjusted by a plurality of paired threaded fasteners 101 provided in a pair of through-going bores 105 located at the proximal end of the saddle members to keep the saddle members from directly engaging the saddle platform.

A partially threaded bore 55 extends through the tremolo arm block 53 and into the spring mounting block 42. As shown in FIG. 4 the bore 55 consists of a stepped axially aligned wider smooth section 55*a* and a narrower threaded section 55*b*. The wider smooth section 55*a* holds a clutch 110 for the tremolo arm 112. The clutch 110 is a cylindrical piece of material selected to provide, in combination with the pressure applied by a set screw 114 passing through the threaded set screw bore 115, a consistent frictional force against the tremolo arm 112. The clutch material can be constructed of several materials including Teflon or various types of plastics or other natural or synthetic materials. The clutch mechanism can also be formed of material which make it capable of resilient deformation in some embodiments to provide a more sensitive feel to the player. The tremolo arm 112 is used to rotate the saddle platform 40 and associated structures. The novel clutch assembly provides for easier, more sensitive playing and a more durable tremolo arm connection. The clutch assembly provides the user with an improved means of adjusting and maintaining the frictional force between tremolo arm and the rotatable portion of the tremolo to provide a smoother rotation of the tremolo arm in a path above the surface of the musical instrument so that the player can easily and reliably rotate the handle relative to the saddle platform to move the tremolo arm toward or away from the strings of the instrument to change the string tension while playing. The instrument player will frequently desire the tremolo arm 112 to be moved away from the strings 88 so that the instrument can be played without using the arm 112 to rotate the tremolo assembly. In this case the player rotates the tremolo arm 112 so that it is no longer over the strings 88. Consequently, the tremolo arm 112 is rotated back and forth many times during a performance. The clutch 110 assures that the tremolo arm 112 does not become loose but rather maintains a consistent action by ensuring that the torsional frictional force between the tremolo arm 112 and clutch 110 remains approximately constant.

When the saddle is in place on the instrument 24, the cone bar 60 and associated cones 71 are biased against the conical tips 57 to create a fulcrum. The biasing forces are caused by the tension in the strings 88 on one side of the fulcrum and by the tension in the coil springs 35 on the other side. The plurality of coil springs 35 are secured to an inside surface of the instrument 24 through the spring and claw assembly 117.

The spring and claw assembly 117 is shown in detail in FIGS. 18 and 19. The claw has a base 119 with screw holes 120 and a back section 123 that holds several claws 125 angled at approximately 45 degrees from the plane of the back section. The claws 125 are evenly spaced to provide a balanced force against the spring mounting block 42. The base 119 is secured to the instrument body 24 by screws 127. The spring force can be adjusted by changing the depth to which the screws 127 penetrate the instrument body 24. The coil springs 35 are secured to the spring mounting block 42 by placing the hook ends of the springs 35 in the respective bores 84 as shown in FIG. 2.

It can thus be seen that the saddle platform or plate portion of the tremolo assembly incorporates an integral casted mounting block which serves as the locus of attachment for a coil spring assembly to provide part of the biasing necessary to bias the cone bars against the conical tips. The plurality of springs connected to the block resist the rotating force exerted on the block and saddle plate or platform by the tensioned strings and thus hold the rotating portion of the tremolo in equilibrium until the player depresses or pulls back on the tremolo arm. The top of the saddle platform and instrument strings guide the longitudinal motion of the saddles along the direction of the strings to perform the bridging function. The tremolo assembly provides the user with an easy and convenient way of installing and removing strings on the instrument by providing the user with a plurality of appropriately shaped bores on the rotatable portion of the assembly to secure the eyelets on the strings to the assembly and at the same time allow easy passage of the strings out of the tremolo assembly toward the tuning pegs on the head of the instrument.

In the forgoing description, the invention has been described with reference to a particular preferred embodiment, although it is to be understood that specific details shown are merely illustrative, and the invention may be carried out in other ways without departing from the true spirit and scope of the following claims:

I claim:

1. A string mounting and tuning device for use in the body of a stringed instrument comprising:

(a) a member with a planar surface pivotally disposed within an opening in the surface of said body of said stringed instrument with said planar surface of said member being substantially coplanar with said surface of said stringed instrument body in an unpivoted position;

(b) string attachment means disposed in said member to hold one end of each string of said stringed instrument;

(c) string support means movably mounted on said planar surface of said member;

(d) said string support means comprising a plurality of linearly and angularly adjustable string saddles spaced apart at least 0.010 inches to preclude cross contamination of string frequencies, each of said string saddles being provided with means for a string to pass from the member through the string saddle along a groove defined on the top of the string saddle to guide the string of the stringed instrument, each of said string saddles being elevated above said member planar surface by adjustment threaded support means to adjust the height of an end of the string saddle so that a heel of the string saddle does not engage the member planar surface.

2. A string mounting and tuning device as claimed in claim 1 wherein said member is provided with a saddle support plate with an open end and a flange located distally from said open end, said flange being provided with a plurality of throughgoing bores, each bore providing a means of passage for a longitudinal adjustment screw so that each longitudinal adjustment screw extends through the respective bore and threadably engages a string saddle allowing the position of each saddle to be selectively adjusted by turning said longitudinal adjustment screw and a plurality of saddle spring members, each saddle spring member being disposed around one of said longitudinal adjustment screws between said string saddle and said flange to bias said string saddle away from said flange.

3. A string mounting and tuning device as claimed in claim 1 wherein said member and each said string saddle are constructed of the same metallic alloy.

4. A string mounting and tuning device as claimed in claim 3 wherein said metallic alloy is a zinc alloy using zinc having a thermal conductivity 113.0 W/mK at 70° to 140° C.

5. A string mounting and tuning device as claimed in claim 3 wherein said metallic alloy is a zinc alloy Number 3 Die Casting Alloy.

6. A string mounting and turning device as claimed in claim 1 wherein string saddles are spaced apart a distance ranging from about 0.010 inch to about 0.018 inch.

7. A string mounting and tuning device as claimed in claim 1 wherein string saddles are spaced apart a distance of about 0.014 inch.

8. A string mounting and tuning device as claimed in claim 1 wherein said member planar surface and each said string saddle are coated with chrome.

9. A string mounting and tuning device for use in the body of a stringed instrument, comprising:

(a) a housing defining a planar section with a planar surface and an integral string support block extending from said planar section, said housing being pivotally mounted within a cavity in the surface of said body of said stringed instrument such that said planar surface is substantially coplanar with said surface of said body;

(b) string attachment means disposed in said housing to hold one end of each string of said stringed instrument;

(c) string support means movably disposed on the planar surface of said planar section; said string support means comprising a plurality of spaced apart saddle members; and saddle member positioning means for orienting each saddle member above and spaced from said planar surface; and (d) handle means attached to said housing to control the pivoting of said housing, said handle means comprising an angularly shaped rod rotatably disposed within a handle bore defined by said housing.

10. A string mounting and tuning device as claimed in claim 9 wherein said string saddles are spaced apart from each other a distance ranging from about 1 to about 8 mm.

11. A string mounting and tuning device as claimed in claim 9 wherein said string saddles and said housing are constructed of the same metal alloy.

12. A string mounting and tuning device as claimed in claim 11 wherein said metal alloy is a zinc alloy.

13. A string mounting and tuning device for use in the body of a stringed instrument, comprising:

(a) a L-shaped member pivotally disposed within a cavity in said body of said stringed instrument such that a surface of said L-shaped member is substantially coplanar with said surface of said body; said L-shaped member comprising a saddle platform and a biasing means attachment block;

(b) string attachment means disposed in said biasing means attachment block to hold one end of each string of said stringed instrument;

(c) string support means movably mounted on a saddle platform of said L-shaped member; said string support means comprising a plurality of linearly and angularly adjustable string saddles spaced from each other a distance ranging from about 0.010 inch to about 0.018 inch, each of said string saddle being provided with means for a string to pass from the member through the spring saddle guide along a groove defined on the top of the string saddle guide to guide the string to the stringed instrument;

(d) pivot point receiving means provided beneath said surface of said L-shaped member to pivotally receive pivot points means;

(e) pivot point means engaging said pivot point receiving means to create a plurality of pivot points within said stringed instrument for said L-shaped member;

(f) biasing means for biasing said pivot point receiving means on said L-shaped member against said pivot points, said biasing means comprising a plurality of spring members secured at one end to said biasing means attachment block of said L-shaped member and secured at the other end to a spring anchoring means secured to the interior of said stringed instrument, said plurality of spring members acting together to balance the rotational force exerted on the L-shaped member caused by the instrument strings; and (g) a rotatable tremolo arm mounted to said L-shaped member to control the selective clockwise or counter clockwise pivoting of said L-shaped member.

14. A string mounting and tuning device as claimed in claim 13, wherein each string saddle is provided with a pair of adjustable threaded supports, each support being disposed in a threaded bore on opposite sides of said groove to adjust the height of the end of the string saddle in respect to a planar surface of said saddle platform so that said string saddles do not engage said saddle platform.

15. A string mounting and tuning device as claimed in claim 13 wherein said saddle platform section has a saddle support plate with a flange at the distal end located away from a proximal open end of said saddle support plate, said flange being provided with a plurality of apertures, each aperture providing a means of passage for a longitudinal adjustment screws so that each longitudinal adjustment screw extends through an aperture and threadably engages a string saddle allowing the position of each saddle to be adjusted by turning the respective longitudinal adjustment screw and a plurality of saddle spring members, each saddle spring member being disposed around one of said longitudinal adjustment screws between said string guide saddle and said flange to bias said string saddle guide away from said flange.

16. A string mounting and tuning device as claimed in claim 13 wherein said saddle platform and said each string saddle are constructed of the same metallic alloy.

17. A string mounting and tuning device as claimed in claim 16 wherein said metallic alloy is a zinc magnesium alloy.

18. A string mounting and tuning device as claimed in claim 16 wherein said metallic alloy is a zinc alloy Number 3 Die Casting Alloy.

19. A string mounting and tuning device as claimed in claim 13 wherein said saddle platform and each said string saddle is constructed of the same metallic alloy.

20. A string mounting and tuning device for use in the body of a stringed instrument, comprising:

(a) a member with a planar surface pivotally disposed within an opening in the surface of said body of said stringed instrument with said planar surface of said member being substantially coplanar with said surface of said stringed instrument body in an unpivoted position;

(b) string attachment means disposed in said member to hold one end of each string of said stringed instrument;

(c) string support means movably mounted on said planar surface of said member, said string support means and said planar surface having a material composition which is the same;

(d) said string support means comprising a plurality of linearly and angularly adjustable string saddles spaced apart to prevent touching and precluding cross contamination of string frequencies, each of said string saddles being elevated above said member planar surface by adjustment threaded support means to adjust the height of an end of the string saddle so that a heel of the string saddle does not engage the member planar surface.

* * * * *